US010018957B2

(12) United States Patent
Causey

(10) Patent No.: US 10,018,957 B2
(45) Date of Patent: Jul. 10, 2018

(54) SYSTEMS AND METHODS FOR REUSING IMAGING GEARS

(71) Applicant: Static Control Components, Inc., Sanford, NC (US)

(72) Inventor: Anthony D. Causey, Fuquay-Varina, NC (US)

(73) Assignee: Static Control Components, Inc., Sanford, NC (US)

( * ) Notice: Subject to any disclaimer, the term of this patent is extended or adjusted under 35 U.S.C. 154(b) by 6 days.

(21) Appl. No.: 14/485,178

(22) Filed: Sep. 12, 2014

(65) Prior Publication Data

US 2016/0026149 A1 Jan. 28, 2016

Related U.S. Application Data

(60) Provisional application No. 62/029,773, filed on Jul. 28, 2014.

(51) Int. Cl.
*G03G 21/16* (2006.01)
*G03G 15/00* (2006.01)

(52) U.S. Cl.
CPC ..... *G03G 21/1647* (2013.01); *G03G 15/751* (2013.01); *G03G 21/1671* (2013.01); *G03G 2215/00987* (2013.01)

(58) Field of Classification Search
CPC .. G03G 15/751; G03G 15/757; G03G 21/181; G03G 21/1857; G03G 2215/00978; G03G 15/75; G03G 2221/1606; G03G 2221/1669
USPC ..... 399/109, 117
See application file for complete search history.

(56) References Cited

U.S. PATENT DOCUMENTS 7,747,189 B2 6/2010 Shanun
2012/0247267 A1* 10/2012 Wazana ..... F16H 57/0025 74/640

OTHER PUBLICATIONS

Recharger Magazine (Jan. 1994, vol. 5, No. 5) p. 19.
Recharger Magazine (Aug. 1994, vol. 5, No. 12) p. 125.
Recharger Magazine (Nov. 1995, vol. 7, No. 3) pp. 161 and 163.
Recharger Magazine (Mar. 1996, vol. 7, No. 7) p. 207.
Recharger Magazine (May 1996, vol. 7, No. 9) p. 185.
Recharger Magazine (Sep. 1996, vol. 8, No. 1) p. 49.
Recharger Magazine (Jan. 1997, vol. 8, No. 5) p. 163.
Recharger Magazine (Jul. 1997, vol. 8, No. 11) p. 200.
Recharger Magazine (Apr. 2003, vol. 14, No. 8) p. 34.

* cited by examiner

*Primary Examiner* — Benjamin Schmitt

(57) ABSTRACT

Systems and methods of reusing an imaging component include providing a used photoconductive drum assembly comprising a cylindrical photoconductive drum and a gear hub extending from an end of the photoconductive drum; removing the gear hub from the end of the photoconductive drum; and crimping a replacement photoconductive drum to the gear hub to form a remanufactured drum assembly.

3 Claims, 9 Drawing Sheets

SYSTEMS AND METHODS FOR REUSING IMAGING GEARS

The present application claims the benefit of U.S. Provisional Patent Application No. 62/029,773 filed Jul. 28, 2014 which is incorporated by reference herein in its entirety.

BACKGROUND

The present invention generally relates to remanufacturing or repairing replaceable imaging components, and more particularly to apparatus and techniques for removing a drum gear from a drum, such as an organic photo conductor (OPC) drum, for example, and attaching that drum gear to another drum.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

OPC drums may include a coated aluminum tube having hubs extending from each end of the tube. One hub may include a gear, such as a tri-lobe gear or a dongle gear, which engages with the printer and is driven by the printer to rotate the OPC drum and/or other combination of elements. Typically, the OPC drum is rotatably held in place by opposing plates or brackets. During the remanufacturing of a laser printer toner cartridge, the OPC drum may need to be replaced due to the wear or damage to the OPC drum. When replacing the OPC drum, it may be desirable to reuse all or part of the drum gears as these parts typically have a longer lifespan than the rest of the drum. Previously, adhesive has been used to attach the drum gears to replacement OPC drum. However, this technique may suffer from several disadvantages, including increasing the difficulty of reusing the drum gears for several remanufacturing cycles and the need to modify or scratch the surface of the drum gears to ensure adequate adhesion between the drum gear and the interior of the OPC drum.

SUMMARY

In one aspect of the present invention a methods of reusing an imaging component include providing a used photoconductive drum assembly comprising a cylindrical photoconductive drum and a gear hub extending from an end of the photoconductive drum; removing the gear hub from the end of the photoconductive drum; and crimping a replacement photoconductive drum to the gear hub to form a remanufactured drum assembly.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing, reusing or remanufacturing a toner cartridge or parts thereof, such as an OPC drum, are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
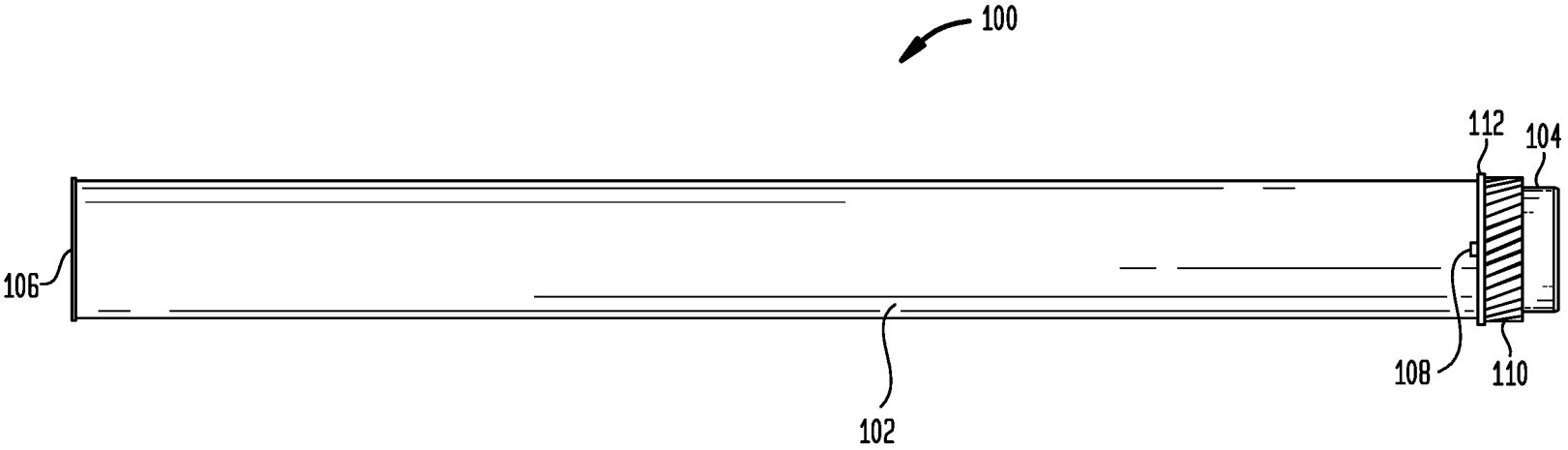
FIG. 1 shows a side view of a drum assembly.

FIG. 1 shows a side view of a drum assembly 100. The drum assembly 100 may include a photoconductive drum 102, such as an OPC drum for example, comprising a coated cylindrical aluminum tube. A gear hub 104 extends from a first end of the drum 102. The gear hub 104 may include gear teeth 110 and a rim 112. A gear (not shown), such as a dongle gear or a tri-lobe gear, may extend from the gear hub 104 and engage with a printer which drives the rotation of the gear hub 104. A nondriven hub 106 may extend from a second end of the drum 102. The nondriven hub 106 may have an outer diameter greater than an outer diameter (24 mm for example) of the photoconductive drum 102. The rim 112 may have an outer diameter of 27 mm for example. The gear hub 104 may be held in place by crimps 108 formed in opposing sides of the first end of the drum 102, an adhesive, or other techniques.

When a spent toner cartridge including the drum assembly 100 is remanufactured, it may be desirable to replace the photoconductive drum 102 with a new or recoated drum but reuse the gear hub 104. In one aspect of the present invention, the spent toner cartridge may be disassembled to allow removal of the drum assembly 100. Alternatively, a cutter, such as a pipe cutter or hacksaw for example, may be used to make one or more cuts through the photoconductive drum 102 to allow the drum assembly 100 to be removed in two or more pieces.

Figure 2A:
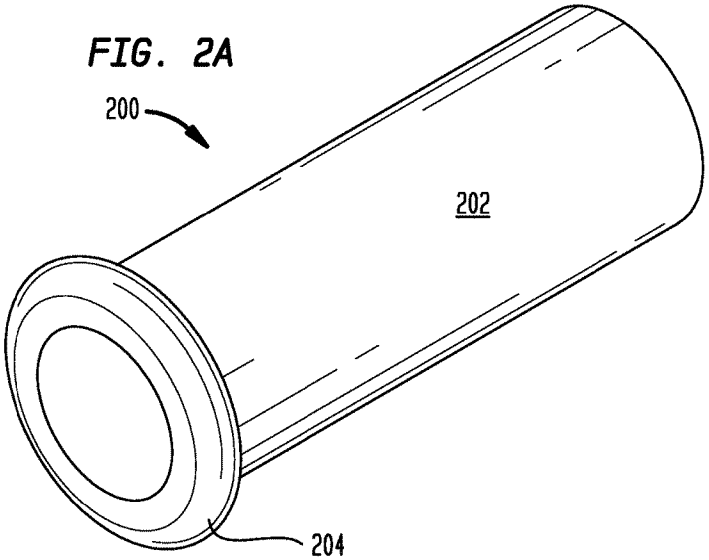
FIG. 2A shows an isometric view of a gear hub removal tool.
Figure 2B:
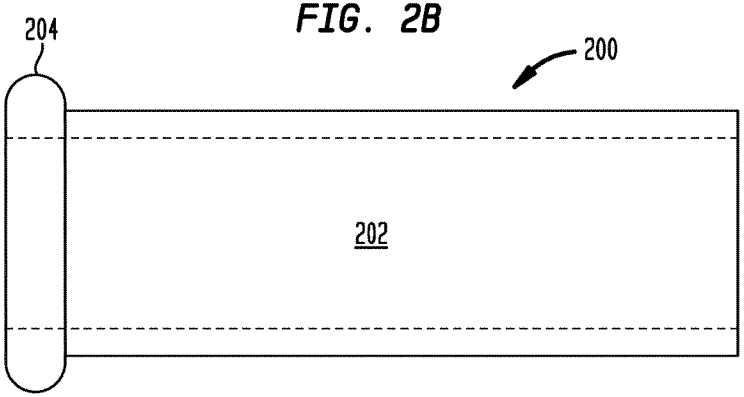
FIG. 2B shows a side view of the gear hub removal tool of FIG. 2A.
Figure 2C:
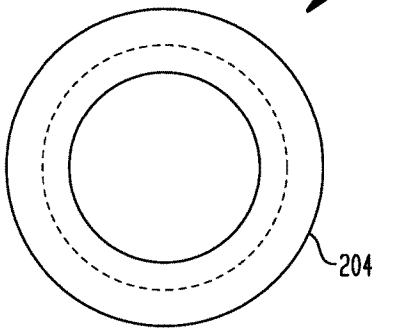
FIG. 2C shows an end view of the gear hub removal tool of FIG. 2A.

After the photoconductive assembly 100 has been removed from the spent toner cartridge, the gear hub 104 may be removed. A variety of techniques may be utilized to remove the gear hub 104. FIGS. 2A-2C show views of a gear hub removal tool 200 in accordance with one aspect of the present invention. The gear hub removal tool 200 may include a hollow cylindrical portion 202 and a flange 204. The inner diameter of the cylindrical portion 202 may be sized to be slightly greater than the outer diameter of photoconductive drum 102, but less than the outer diameter of the rim 112. If the gear hub 104 does not include a rim 112, the inner diameter of the cylindrical portion 202 may be sized less than the outer diameter of the gear teeth. For photoconductive drums which have been cut or for which the outer diameter of the nondriven hub 106 are not an impediment, the photoconductive assembly 100 may be inserted into gear hub removal tool 200 with the flange 204 facing the gear hub 104. The gear hub removal tool 200 may then be forcefully moved into contact with gear hub 104 to remove the gear hub 104 from the photoconductive drum assembly 100. In an alternate embodiment, the gear hub removal tool 200 does not include a flange.

Figure 3A:
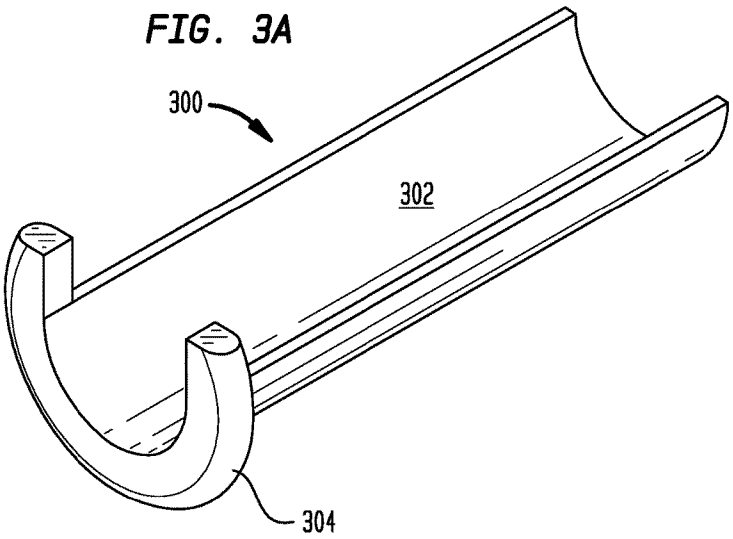
FIG. 3A shows an isometric view of a gear hub removal tool.
Figure 3B:
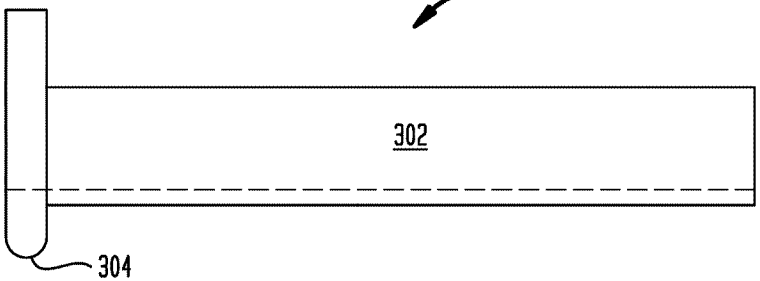
FIG. 3B shows a side view of the gear hub removal tool of FIG. 3A.
Figure 3C:
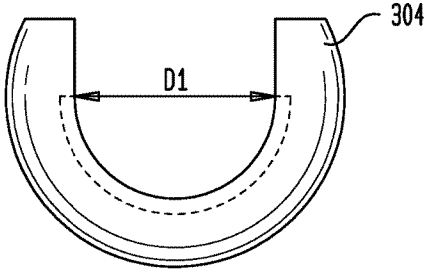
FIG. 3C shows an end view of the gear hub removal tool of FIG. 3A.
Figure 4A:
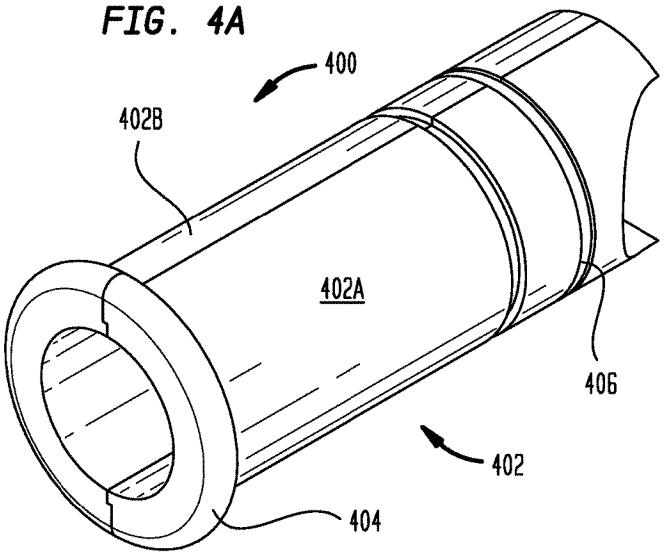
FIGS. 4A and 4B show an isometric view of a gear hub removal tool.
Figure 4B:
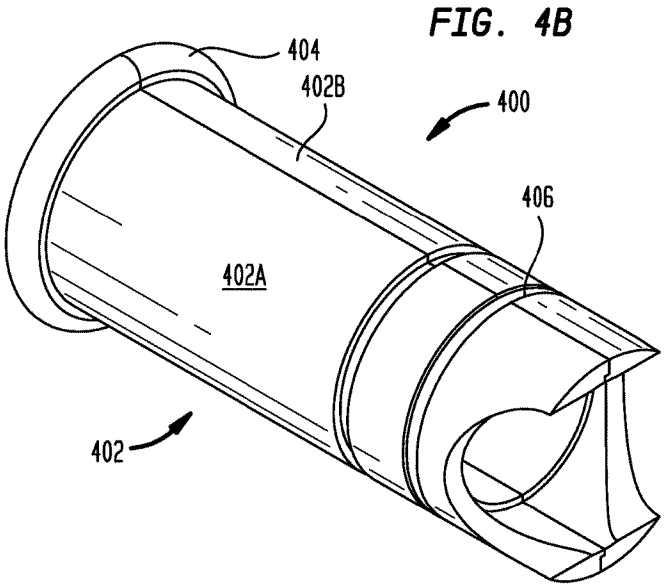
Figure 4C:
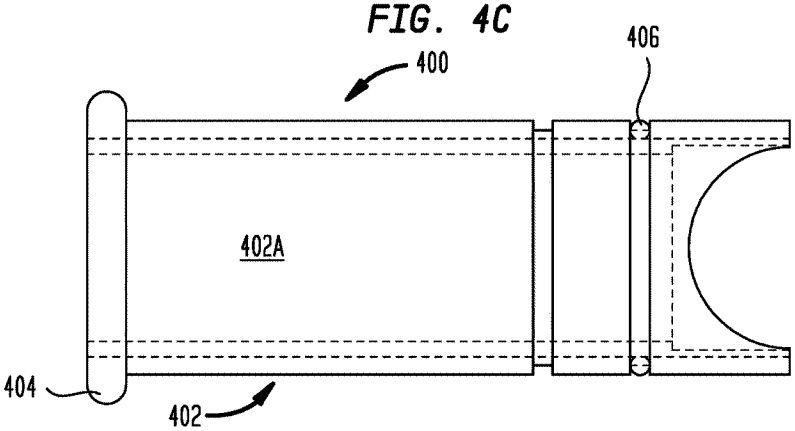
FIG. 4C shows a side view of the gear hub removal tool of FIG. 4A.
Figure 4D:
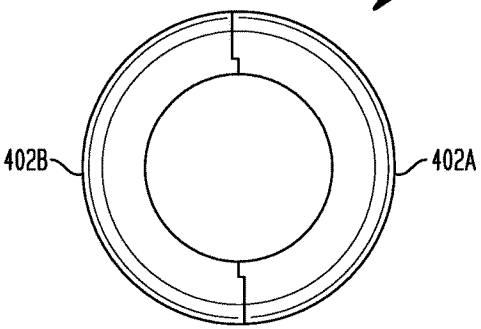
FIG. 4D shows an end view of the gear hub removal tool of FIG. 4A.
Figure 5A:
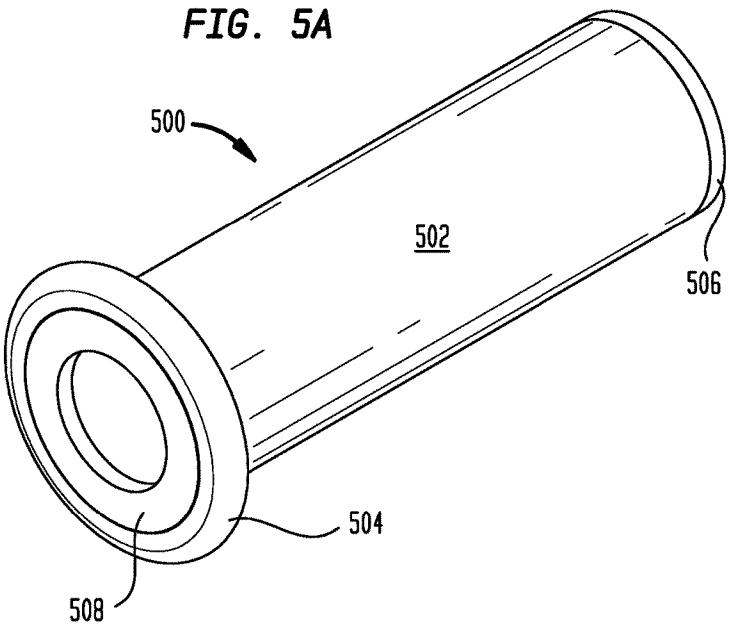
FIGS. 5A and 5B show an isometric view of a gear hub removal tool.
Figure 5B:
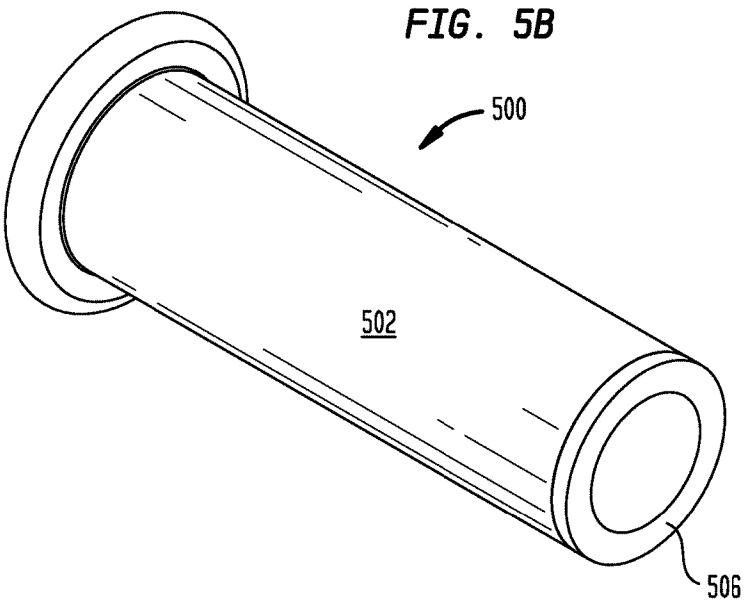
Figure 5C:
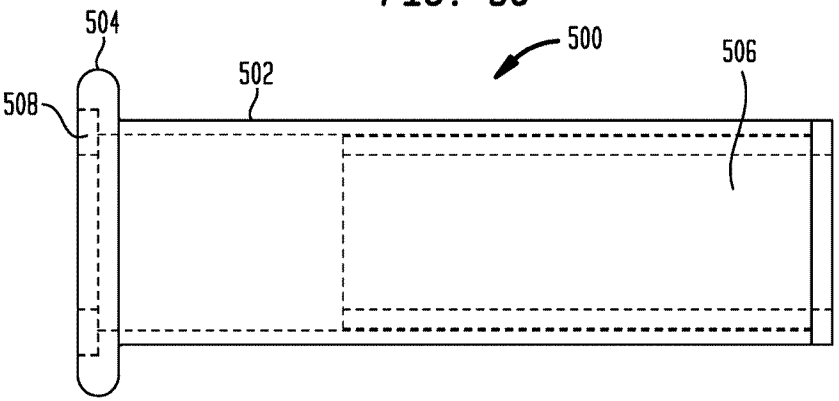
FIG. 5C shows a side view of the gear hub removal tool of FIG. 5A.
Figure 5D:
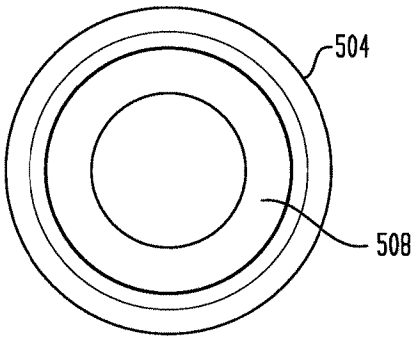
FIG. 5D shows an end view of the gear hub removal tool of FIG. 5A.

For photoconductive drums which have not been cut and the nondriven hub 106 is an impediment to the insertion of the gear hub 104 into the gear hub removal tool 200 (due to the inner diameter of the gear hub removal tool 200 being less than the outer diameter of the nondriven hub 106), an alternative technique may be used. FIGS. 3A-3C show views of a gear hub removal tool 300 in accordance with another aspect of the present invention. The gear hub removal tool 300 may include a trough portion 302 and a flange 304. The inner diameter D1 of the trough portion 302 may be sized to be slightly greater than the outer diameter of the photoconductive drum 102. The photoconductive assembly 102 may be placed in the trough portion 302 with the flange facing the gear hub 104. The gear hub removal tool 300 may then be forcefully moved into contact with the gear hub 104 to remove the gear. The gear may then be cleaned with isopropyl alcohol or other techniques if needed. In an alternate embodiment, the gear hub removal tool 300 does not include a flange.

For photoconductive drums which have not been cut and the nondriven hub 106 is an impediment to the insertion of the gear hub 104 into the gear hub removal tool 200 (due to the inner diameter of the gear hub removal tool 200 being less than the outer diameter of the nondriven hub), another alternative technique may be used. FIGS. 4A-4D show views of a gear hub removal tool 400 in accordance with another aspect of the present invention. The gear hub removal tool 400 includes a hollow cylindrical portion 402 and a flange 404 which may comprise a first half 402A and a second half 402B held together by a flexible O-ring 406 disposed in a slot. The inner diameter of the hollow cylindrical portion 402 may be sized to be slightly greater than the outer diameter of the photoconductive drum 102. The photoconductive assembly 102 may be placed in the trough portion 302 with the flange facing the gear hub 104 by forcing the two halves 402A and 402B apart by stretching the O-ring 406. The gear hub removal tool 400 may then be forcefully moved into contact with the gear hub 104 to remove the gear. In an alternate embodiment, the gear hub removal tool 400 does not include a flange.

FIGS. 5A-5D show views of a gear hub removal tool 500 in accordance with another aspect of the present invention. The gear hub removal tool 500 includes a hollow cylindrical portion 502 and a flange 504. A removable insert 506 is disposed in the hollow cylindrical portion 502 and a removable washer 508 is disposed in the flange 504. The inner diameters of the removable insert 506 and removable washer 508 may be sized to be slightly greater than the outer diameter of photoconductive drum 102, but less than the outer diameter of the rim 112. If the gear hub 104 does not include a rim 112, the inner diameter of the cylindrical portion may be sized less than the outer diameter of the gear teeth. For photoconductive drums which have been cut or for which the outer diameter of the nondriven hub 106 are not an impediment, the photoconductive assembly 100 may be inserted into gear hub removal tool 500 with the flange 504 facing the gear hub 104. The gear hub removal tool 500 may then be forcefully moved into contact with gear hub 104 to remove the gear hub 104 from the photoconductive drum assembly 100. For drums having different diameters than the photoconductive drum 102, differently sized washers and O-rings may be utilized.

Other techniques may be used to remove the gear hub 104. For example, a plunger which is inserted down the length of the photoconductive drum 102 may be used to remove the gear hub 104. Alternatively, a tool may be used to deform the photoconductive drum 102 near the gear hub 104 to loosen the gear hub 104 and allow its removal. After removal, the gear may then be cleaned with isopropyl alcohol or other techniques if needed.

Figure 6:
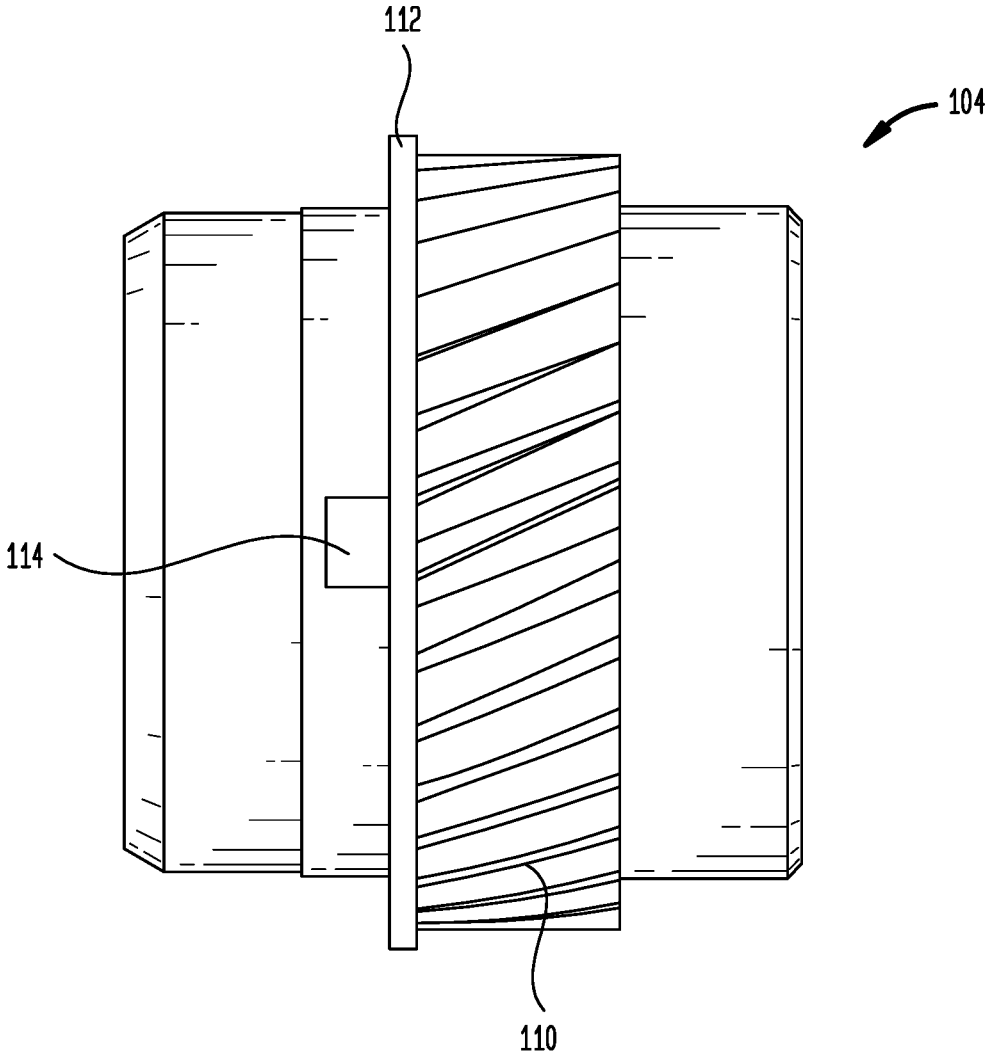
FIG. 6 shows a side view of the gear hub.

FIG. 6 shows a side view of the gear hub 104 which has been removed from the first end of the drum 102. The gear hub 104 may include crimp notches 114 which facilitate the crimping of a drum to the gear hub 104.

Figure 7:
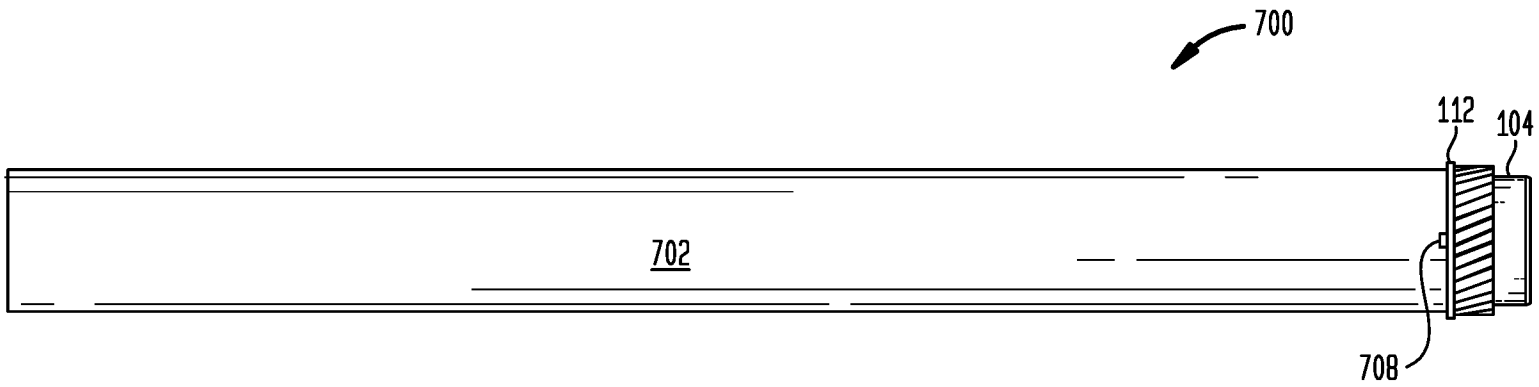
FIG. 7 shows a side view of a remanufactured drum assembly.
Figure 8:
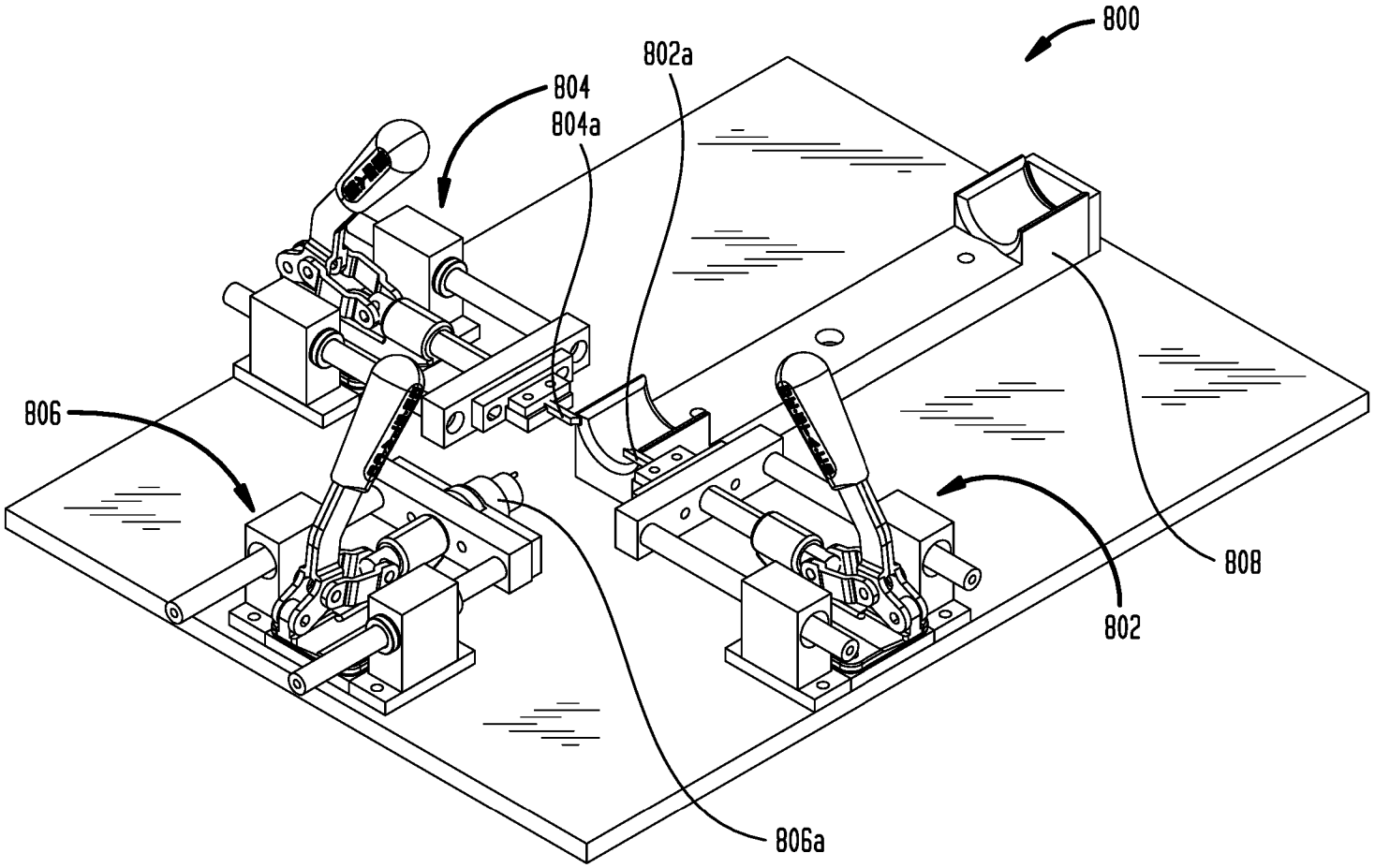
FIG. 8 shows an isometric view of a gear hub installation tool.
Figure 9:
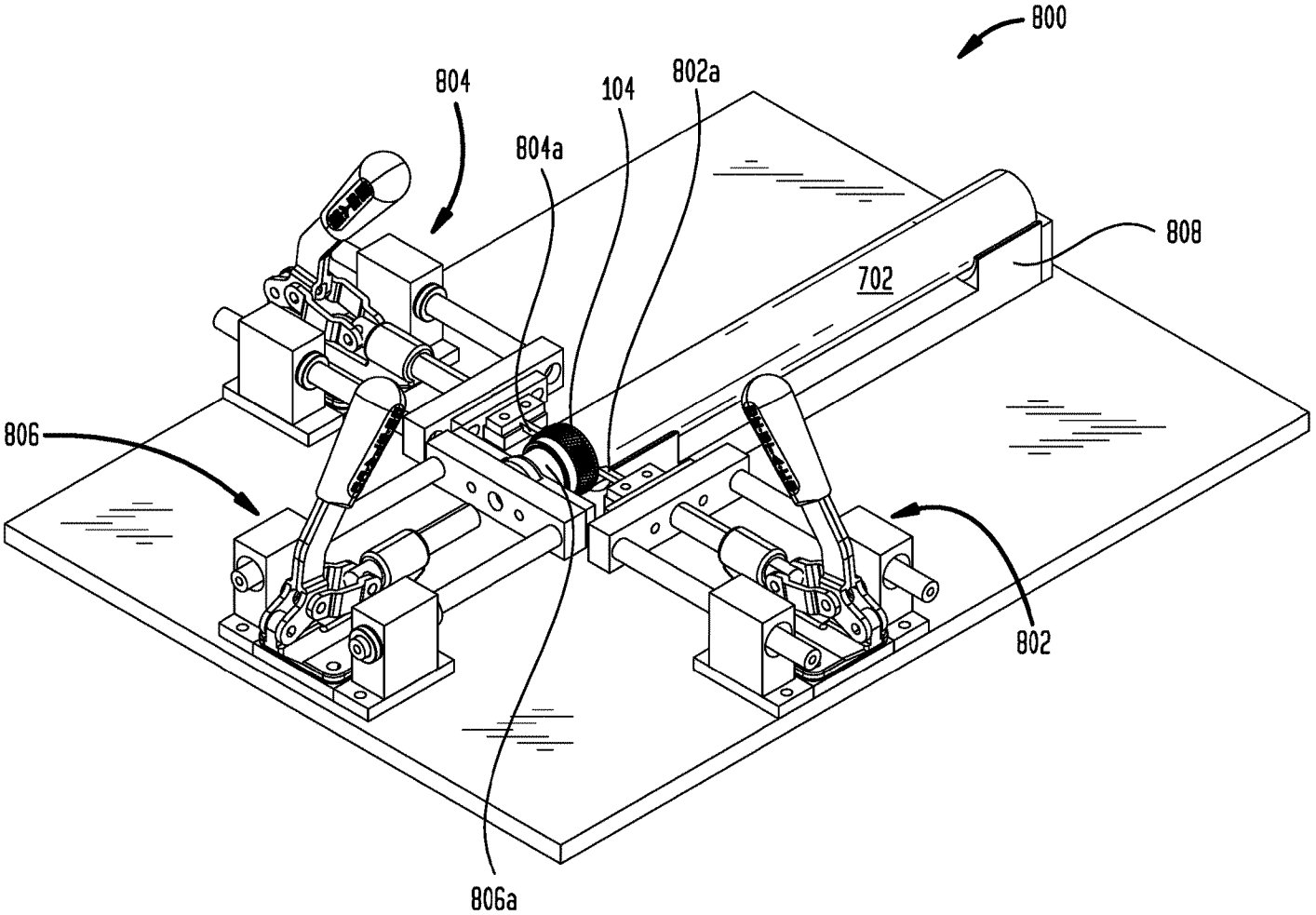
FIG. 9 shows an isometric view of a gear hub installation tool with a gear hub and a replacement drum.

After the gear hub 104 has been removed from the photoconductive drum 102, the gear hub 104 may be attached to a replacement photoconductive drum 702 to form a remanufactured drum assembly 700, as shown in FIG. 7. In a preferred embodiment, the gear hub 104 is inserted into an end of the replacement photoconductive drum 702 and is crimped in two places in opposing sides of the drum 702 to form crimps 708. Crimping deforms the metal of the replacement photoconductive drum 702 to hold the gear hub 704 in place. FIG. 8 shows a gear hub attachment apparatus 800 in accordance with one aspect of the present invention and FIG. 9 shows the gear hub attachment apparatus 800 with the replacement photoconductive drum 702 being crimped onto the gear hub 104. The gear hub attachment apparatus include crimp presses 802 and 804, gear press 806, and a drum holder 808. The crimp presses 802 and 804 include a crimp stakes 802*a* and 804*a*, respectively. The gear press 806 includes a gear hub retaining member 806*a*. To attach the gear hub 104 to the replacement photoconductive drum 702, the photoconductive drum 702 is placed in the drum holder 808 with the crimp notches 114 aligned with the crimp stakes 802*a* and 804*a*. The gear press 808 may then be used to insert and hold the gear hub 104 into the photoconductive drum 702. The crimp presses 802 and 804 may then be used to form crimps 708 by forcing the crimp stakes 802*a* and 804*a* to deform the metal of the replacement photoconductive drum 702 into the crimp notches 114. In one aspect, the tips of the crimp stakes 802*a* and 804*a* may be rounded so that metal of the replacement photoconductive drum 702 bends cleanly and does not break or become weak.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of removing an imaging component comprising:

providing a used photoconductive drum assembly comprising a cylindrical photoconductive drum and a gear hub extending from an end of the photoconductive drum, said cylindrical photoconductive drum having an outer surface and a drum outer diameter, said gear hub including at least one of a gear teeth or a rim, said at least one of the gear teeth or the rim having a hub outer diameter greater than the drum outer diameter;

providing a gear removal tool comprising a cylindrical portion having a tool inner diameter greater than the drum outer diameter and less than the hub outer diameter;

inserting a portion of the photoconductive drum into the gear removal tool;

moving the gear removal tool along at least a portion of the length of the outer surface of the photoconductive drum; and contacting at least one of the gear teeth or rim with the gear removal tool to remove the gear hub from the photoconductive drum assembly.

2. The method of claim 1 wherein the gear removal tool further comprises a flange and the step of contacting comprises contacting at least one of the gear teeth or rim with the flange of the gear removal tool.

3. The method of claim 1 wherein the gear removal tool is handheld and the step of moving comprises moving the gear removal tool by hand.

* * * * *